United States Patent [19]

Hickerson

[11] Patent Number: 4,903,355

[45] Date of Patent: Feb. 27, 1990

[54] TORSO SLING FOR A HOIST FOR LIFTING AND SUPPORTING A PHYSICALLY DISABLED PERSON

[76] Inventor: Karen M. V. Hickerson, 296 North St., Rural Hall, N.C. 27045

[21] Appl. No.: 387,176

[22] Filed: Jul. 28, 1989

[51] Int. Cl.[4] ..... A61G 1/00; A61G 7/10

[52] U.S. Cl. ..... 5/89

[58] Field of Search ..... 5/89, 83, 86, 84, 85, 5/81 R, 81 B

[56] References Cited

U.S. PATENT DOCUMENTS

| | | | |
|---|---|---|---|
| 2,523,891 | 9/1950 | Wallstrom | 5/89 |
| 2,663,031 | 12/1953 | Kalthoff | 5/89 |
| 3,252,704 | 5/1966 | Wilson | 5/83 |
| 3,597,774 | 8/1971 | Warren | 5/84 |
| 4,748,701 | 6/1988 | Marlowe et al. | 5/89 |

FOREIGN PATENT DOCUMENTS

| | | | |
|---|---|---|---|
| 1046202 | 1/1979 | Canada | 5/89 |

*Primary Examiner*—Alexander Grosz

[57] ABSTRACT

A torso sling for lifting, supporting and moving a physically disabled or handicapped person by a hoist or lift having a hanger, from which the torso sling is suspended, has a torso support strap which extends around the torso of the wearer between the waist and armpits, leaving the lower body of the wearer unencumbered for removal of the wearer's clothing from the waist down. Suspension straps attached to the torso support strap extend upwardly on both sides of the wearer in front of and behind the wearer's armpits and are connected at their upper ends to the hanger of the hoist. Underarm support members attached to the suspension straps extend beneath and support the armpits of the wearer on both sides. An optional thigh support strap has opposite ends which extend upwardly on both sides of the thighs of the wearer and has an intermediate portion which extends beneath and supports the thighs and the upper ends of the thigh support strap are connected to the hanger of the hoist.

7 Claims, 5 Drawing Sheets

TORSO SLING FOR A HOIST FOR LIFTING AND SUPPORTING A PHYSICALLY DISABLED PERSON

BACKGROUND OF THE INVENTION

This invention relates to a torso sling for lifting and supporting a physically disabled or handicapped person by a hoist.

Manually lifting and supporting a person rendered immobile by physical disability or handicap from a bed, wheelchair or the like is both extremely difficult and dangerous to the immobile person as well as the attendants. Attendants frequently suffer back injuries, and the person being lifted and supported may be accidentally dropped and seriously injured. Even in the absence of such mishap, the immobile person often suffers bruising from the physical handling.

Additionally, such manual operation usually requires two attendants. Moreover, when the purpose of such manual lifting and supporting is for assisting an immobile person in the use of restroom facilities, it is usually necessary for one of the attendants to physically support the immobile person while the other removes the lower clothing, and both are required to lift the immobile person onto the toilet. Moreover, at least one of the attendants must remain to support the immobile person during evacuation, thereby depriving the person being assisted of his or her privacy.

Slings or harnesses have been developed for use with hoists or lifts which remove much of the physical exertion associated with manual lifting and supporting. Such devices generally provide slings or harnesses which are chair-like as disclosed in U.S. Pat. No. 2,710,975 to Stoen, et al.; U.S. Pat. No. 2,663,031 to Kalthoff; U.S. Pat. No. 3,694,829 to Bakker; U.S. Pat. No. 3,996,632 to Viel; and U.S. Pat. No. 4,739,526 to Hollick.

Such devices use straps or straps together with rigid frames to form a seat, usually in combination with a back support. Some of these devices provide support but do not secure the immobile person in the device. This deficiency presents the danger of falling from the device, especially in the case of an immobile person who experiences involuntary or spastic movements. Additionally, such devices are usually characterized by having one or more seat forming straps or leg straps which encumber the lower body of the immobile person and prevent removal of clothing from the waist down.

Another device disclosed in U.S. Pat. No. 3,597,774, provides underarm support members but is neither adapted to completely lift and support the immobile person nor to secure the immobile person in the device.

Many of the foregoing devices are extremely bulky and cumbersome, difficult to fit to the wearer, and uncomfortable to the wearer.

SUMMARY OF THE INVENTION

The present invention overcomes the problems associated with the prior art and provides a torso sling for a hoist or lift for safely, securely and comfortably lifting, supporting or moving a physically disabled or handicapped person with minimal physical effort.

It is, therefore, an object of the present invention to provide a torso sling for the lifting and supporting of an immobile person which has a torso support strap extending around the torso of the wearer in the region between the waist and armpits and which provides safety and security for the immobile person and eliminates any danger of slipping or falling while being lifted and supported.

Another object of the present invention is to provide a torso sling having a torso support strap which is generally contoured to the shape of the torso of the wearer from the waist area upward to evenly distribute the weight of the wearer, thereby providing comfort to the wearer and avoiding slippage of the torso support strap.

Still another object of the present invention is to provide a torso sling having underarm supports which serve to further distribute the weight of the wearer and provide further comfort and security to the wearer.

A further object of the present invention is to provide a torso sling which does not extend below the waist of the wearer and leaves the entire lower body unencumbered for easy removal of clothing from the waist down.

An additional object of the present invention is to provide a torso sling which enables the wearer to be left safely unattended in the use of restroom facilities, thus allowing the wearer privacy.

A still further object of the present invention is to provide a torso sling which can be easily and conveniently adjusted and fitted to and removed from the wearer.

These and other objects and advantages of the present invention will become more apparent after consideration of the following detailed specification taken in conjunction with the accompanying drawings wherein like characters of reference designate like parts throughout the several views.

DETAILED DESCRIPTION OF THE PREFERRED EMBODIMENT

Reference will now be made in detail to a preferred embodiment of the invention which is illustrated in the accompanying drawings.

Figure 1:
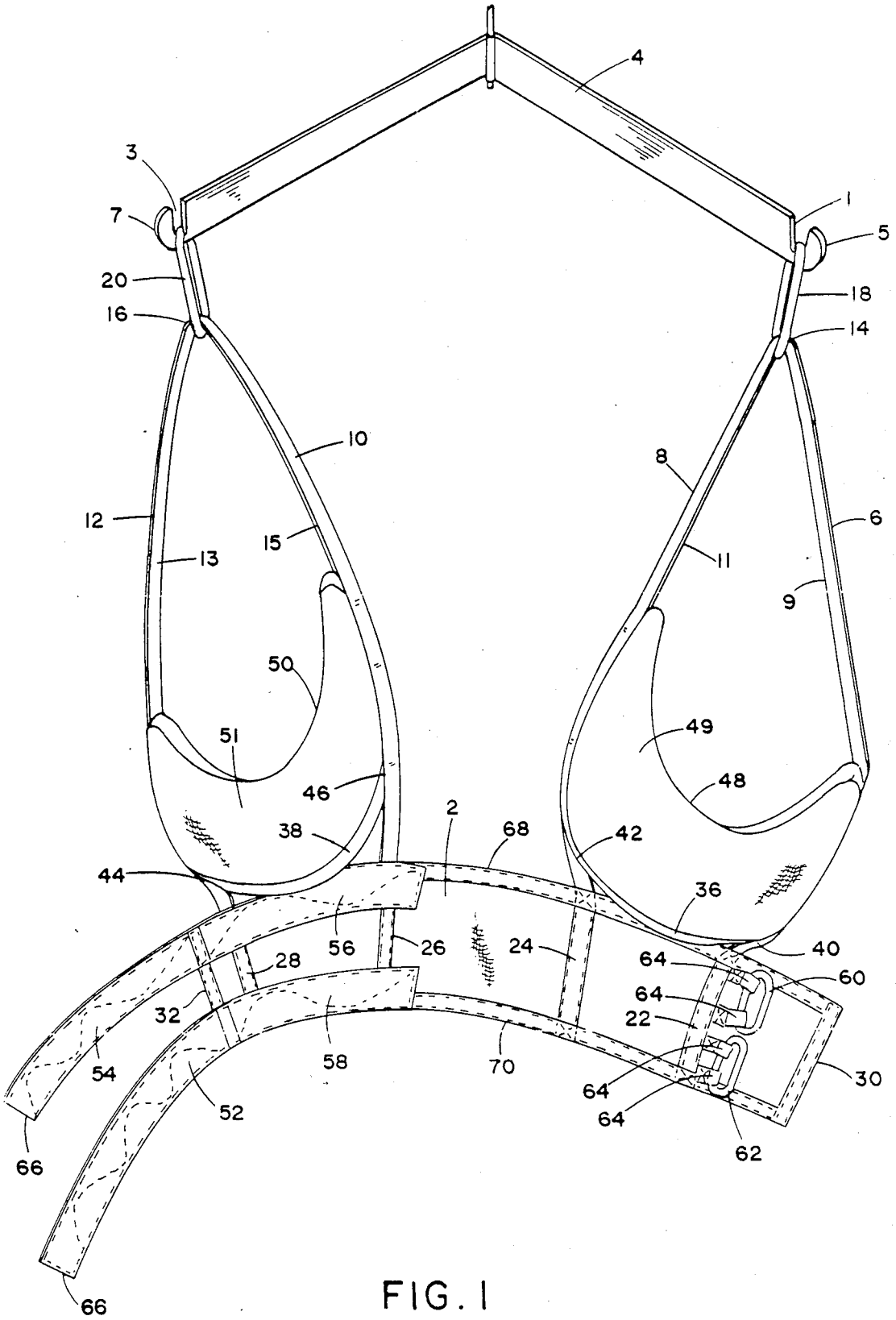
FIG. 1 is a perspective rear view of a torso sling embodying the invention, laid open.
Figure 4:
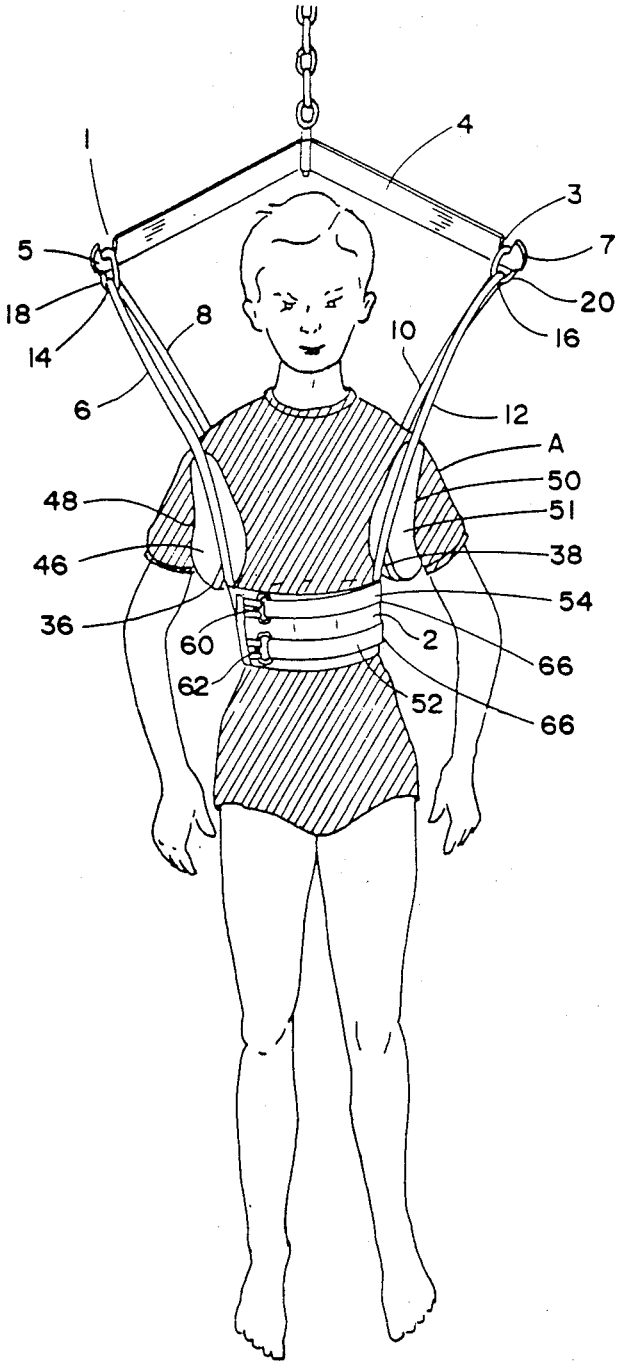
FIG. 4 is a front perspective view of the torso sling of FIG. 1 with a wearer supported therein.

Referring to FIG. 1, and FIG. 4, an immobile person A is supported by support strap 2 which is suspended from hooks 1, 3 formed in the opposite ends 5, 7 of hanger 4 of a hoist or lift (not shown) by a first pair of suspension straps 6, 8 extending upwardly on one side of the immobile person A and a second pair of suspension straps 10, 12 extending upwardly on the other side of the immobile person A. The first pair of suspension straps 6, 8 is connected at its upper end 14 to hook 1 of hanger 4 by connector member 18, and the second pair of suspension straps 10, 12 is connected at its upper end 16 to hook 3 of hanger 4 by connector member 20.

The suspension straps 6, 8, 10, 12 and support strap 2 are made from nylon or other fabric of sufficient strength to support the weight of an adult person. Each of suspension straps 6, 12 is attached at its lower end portion 22, 28, respectively, to support strap 2 at a point proximate the respective opposite ends 30, 32 of suspension strap 2, and each of suspension straps 8, 10 is attached at its lower end portion 24, 26, respectively, to the support strap 2 at a point, spaced laterally from lower end portions 22, 28, respectively, of support straps 6, 12, intermediate the opposite ends 30 and 32, respectively, of support strap 2, so that, when support strap 2 is fitted to a wearer, suspension straps 6, 12, respectively, extend upwardly from support strap 2 on opposite sides of and in front of the armpits on opposite sides of the wearer A, and suspension straps 8, 10, respectively, extend upwardly from support strap 2 on opposite sides of and behind the armpits on opposite sides of the wearer.

One underarm support member 48 of a pair of support members 48, 50 has a horizontally extending strap portion 36 and upwardly extending strap portions 9, 11 and the other underarm support member 50 of the pair of support members 48, 50 has a horizontally extending strap portion 38 and upwardly extending strap portions 13, 15, said horizontally and upwardly extending strap portions being likewise made from nylon or other fabric of suitable strength. Upwardly extending strap portions 9, 11, respectively, are superposed with and attached by sewing or stitching to suspension straps 6, 8, respectively, from the opposite ends 40, 42, respectively, of horizontally extending strap portion 36, upwardly to upper end 14 of suspension straps 6, 8, and upwardly extending strap portions 13, 15, respectively, are superposed with and attached by sewing or stitching to suspension straps 12, 10, respectively, from the opposite ends 44, 46, respectively, of horizontally extending strap portion 38, upwardly to end 16 of suspension straps 10, 12. Underarm support members 48, 50 have padded or cushioned central portions 49, 51, respectively, as illustrated.

Figure 2:
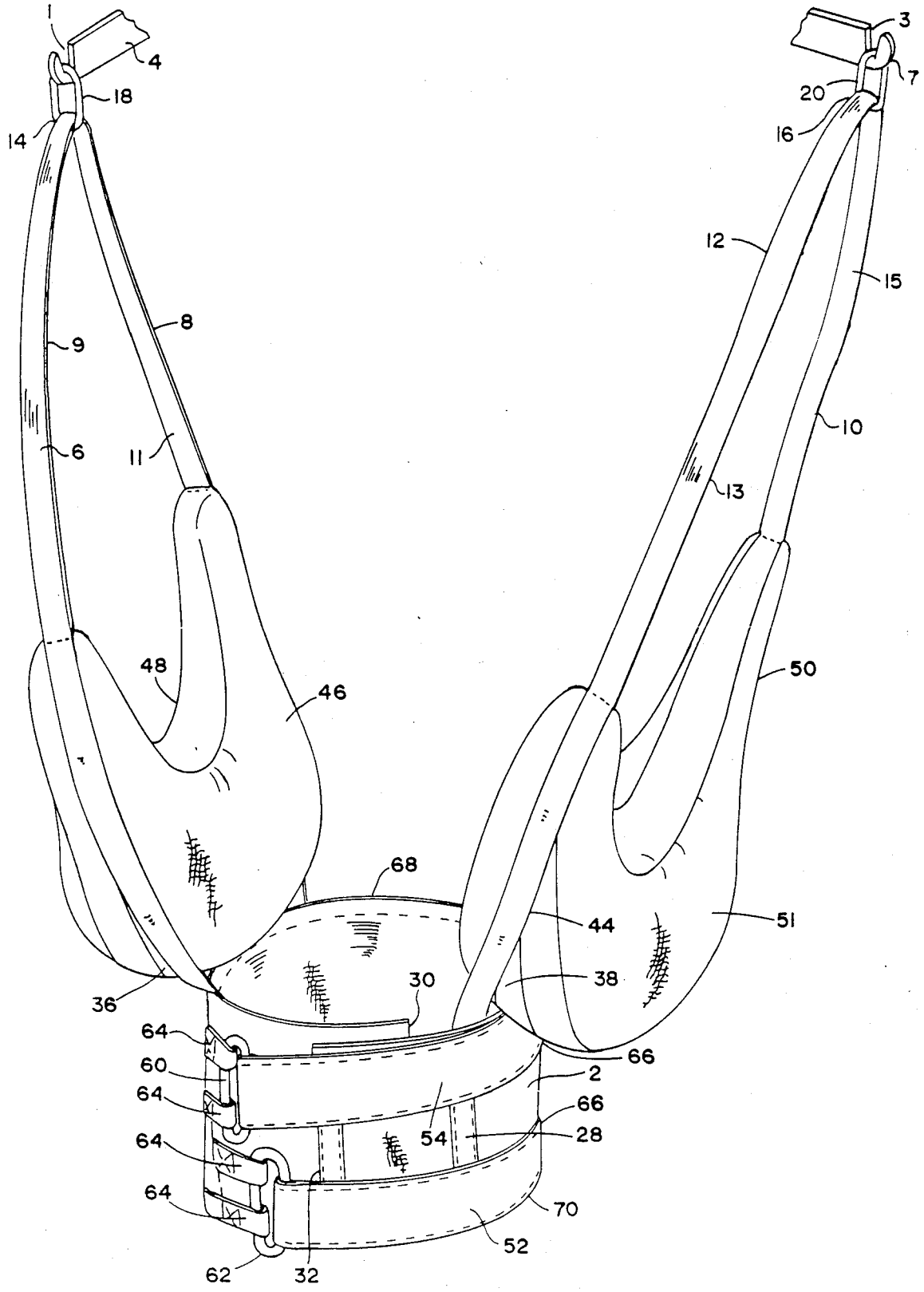
FIG. 2 is a perspective front view of the torso sling of FIG. 1 showing the fastening straps fastened as when fitted to a wearer.

Support strap 2 has a pair of fastening straps 52, 54 of nylon fabric or other fabric of suitable strength, attached at one of their respective end portions 56, 58 to support strap 2 proximate one end 32 of support strap 2 by sewing or stitching. Ring members 60, 62 are attached to support strap 2 proximate the opposite end 30 of support strap 2 by means of loops 64, which are sewn or stitched to support strap 2. When support strap 2 is fitted to a wearer A, the free ends 66 of fastening straps 52, 54, are received by ring members 62, 60, respectively, and drawn through ring members 62, 60 until said support strap 2 is snugly engaged around the torso of the wearer, and the free ends 66 are folded back over the end 32 of support strap 2 as shown in FIG. 2 and releasably attached along support strap 2 adjacent its end 32 by strip fastener. Other suitable releasable fasteners such as buckles or hooks may be substituted for this purpose.

Support strap 2 has an upper edge 68 which is relatively greater in length than its lower edge 70 as shown in FIG. 1, and, support strap 2 increases proportionately in length from its lower edge to its upper edge so that the perimeter formed by its upper edge 68 is greater than the perimeter formed by its lower edge 70 and the length of the perimeter at all points transverse of support strap 2 increases proportionately from its lower edge 68 to its upper edge 70 when support strap 2 is fastened as shown in FIG. 2 and fitted to a wearer as shown in FIG. 4. When so fitted, the lower edge 70 of support strap 2 extends around the torso of wearer A at or above the waist, and the upper edge 68 of support strap 2 extends around the torso of wearer A at or below the armpits. Support strap 2 is thus generally contoured to the shape of the torso of the wearer A and may be adjusted by means of fastening straps 52, 54.

Figure 3:
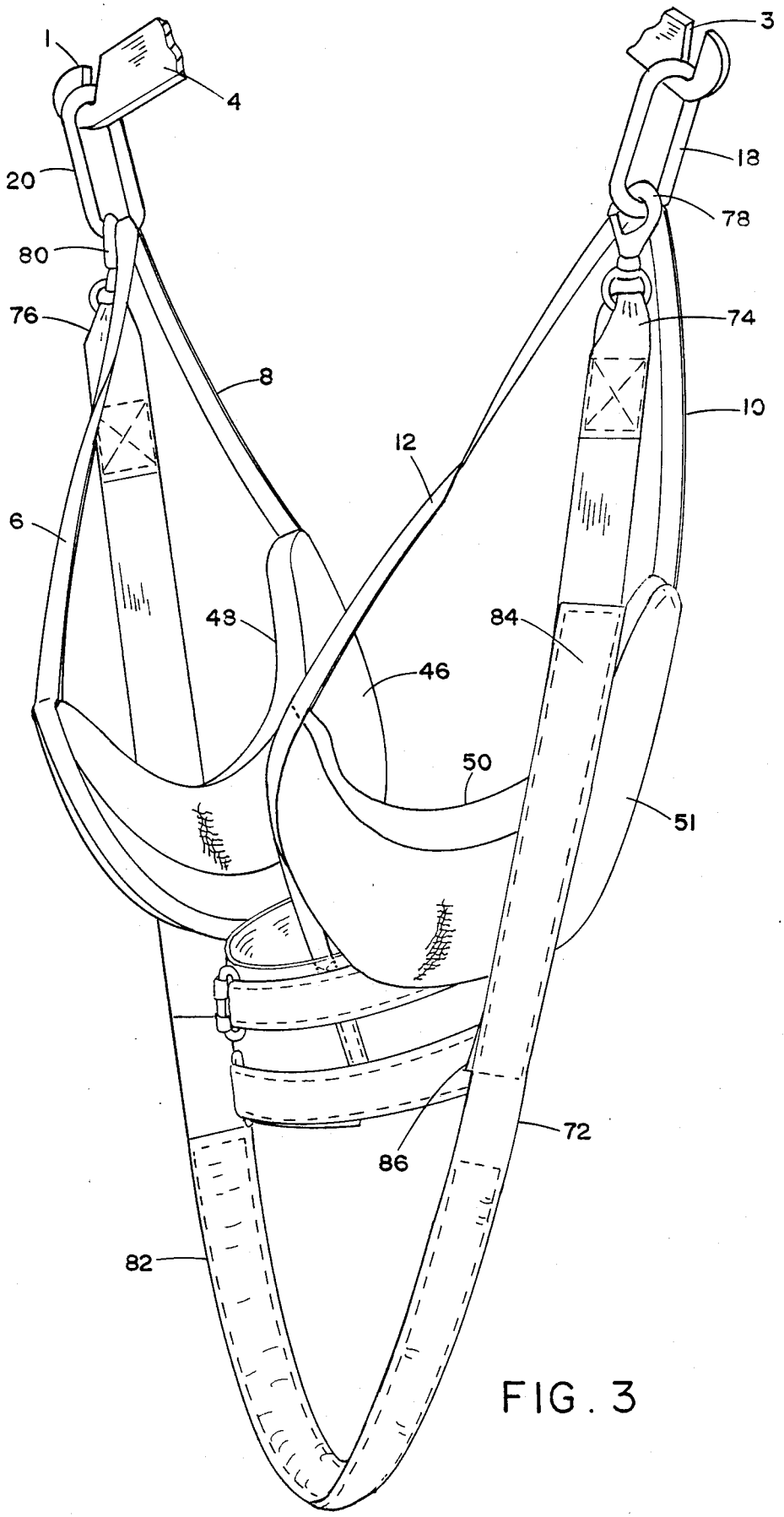
FIG. 3 is a front perspective view of a torso sling embodying the present invention showing the fastening straps fastened as when fitted to a wearer and having a thigh support strap.
Figure 5:
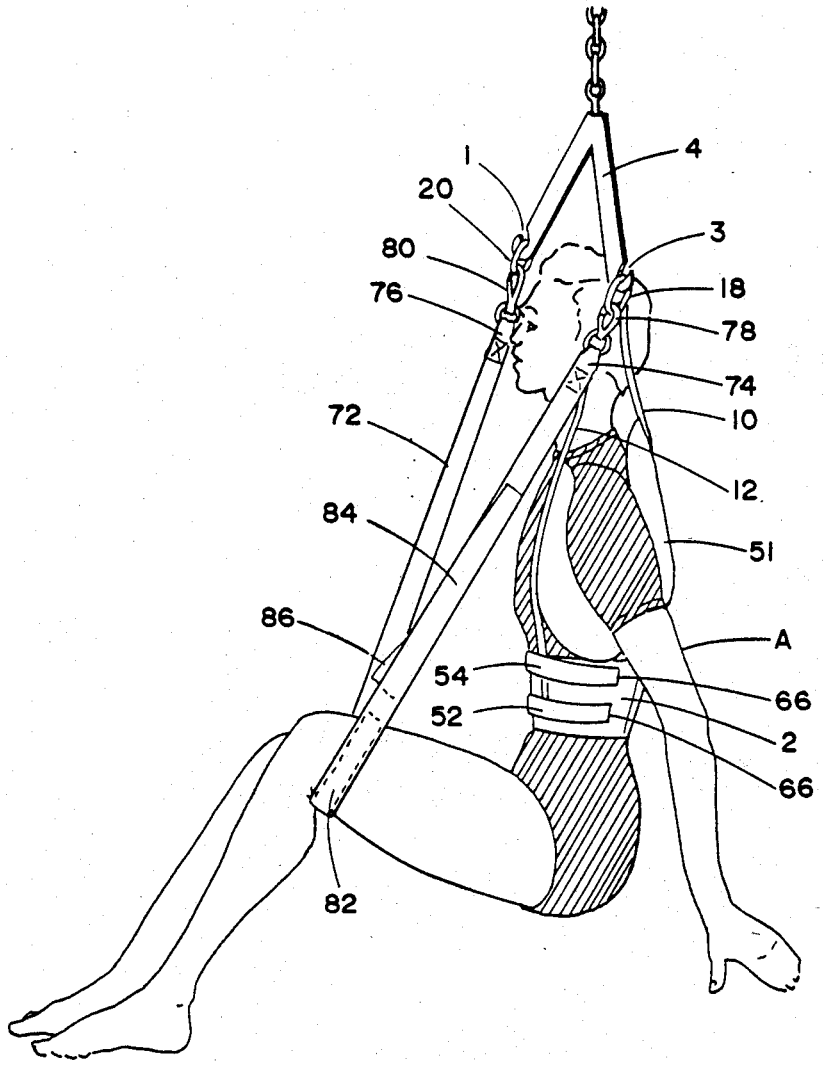
FIG. 5 is a side perspective view of the torso sling of FIG. 3 with a wearer supported therein.

In order to afford additional support to the wearer, an optional thigh support strap 72 as shown in FIG. 3 and FIG. 5, may be provided which is suspended at its opposite ends 74, 76 from hooks 1, 3, respectively of hanger 4 of the hoist or lift (not shown) by fastening hooks 78, 80, respectively, engaging connector members 18, 20, respectively. Thigh support strap 72 has an intermediate portion 82 which extends beneath and supports the thighs of the wearer A as shown in FIG. 5. Thigh support strap 72 also has overlapping sections 84, 86 which are superposed and releasably attached by hook and loop type, or strip, fastener means, such as the ones sold under the trademark of VELCRO fastener to provide for lengthwise adjustment of thigh support strap 72, and intermediate portion 82 of thigh support strap 72 is padded for comfort to the wearer.

It will be apparent to those skilled in the art that various additions, substitutions, modifications, and omissions can be made to the torso sling of the present invention without departing from the scope or spirit of the invention. Thus, it is intended that the present invention cover the additions, substitutions, modifications, and omissions, provided they come within the scope of the intended claims and their equivalents.

What is claimed is:

1. A torso sling for lifting and supporting a physically disabled or handicapped person by a hoist having hanger means comprising torso support means adapted to extend around and be fitted to the torso of a wearer in the region between the waist and armpits, said torso support means including an elongate support strap having an upper edge and a lower edge, said upper edge being greater in length than said lower edge so that the perimeter formed by said support strap upper edge, when said support strap is fitted to a wearer, is greater than the perimeter formed by said support strap lower edge; suspension means extending upwardly from said support strap in the region below the armpits of the wearer and engaging the hanger means of the hoist; the underarm support means carried by said suspension means and adapted to extend beneath and support the armpits of the wearer.

2. A torso sling as claimed in claim 1, further comprising thigh support means adapted to extend beneath the thighs of the wearer and upwardly therefrom to engage the hanger means of the hoist.

3. A torso sling as claimed in claim 2, wherein said thigh support means comprises an elongate thigh support strap having an intermediate portion extending below and supporting the thighs of the wearer and having opposing end portions extending upwardly therefrom on both sides of the thighs of the wearer and having upper ends adapted to be connected by connecting means to the hanger means of the hoist.

4. A torso sling for lifting and support a physically disabled or handicapped person by a hoist having hanger means comprising an elongate support strap adapted to extend around and be fitted to the torso of the wearer in the region between the waist and armpits and having opposing ends adapted to be releasably fastened together by releasable fastening means when said support strap is fitted to the torso of a wearer; a fist and second pair of elongate suspension straps, one of said suspension straps of said first pair of suspension straps having its lower end secured to said elongate support strap and extending upwardly therefrom on one side of and in front of the armpit of the wearer and the other suspension strap of said first pair having its lower end secured to said elongate support strap and extending upwardly therefrom on said one side of and behind the armpit of the wearer, and one of said suspension straps of said second pair of suspension straps having its lower end secured to said elongate support strap and extending upwardly therefrom on the other side of and in front of the other armpit of the wearer and the other suspension strap of said second pair having its lower end secured to said elongate support strap and extending upwardly therefrom on said other side of and behind said other armpit of the wearer, the upper ends of each of said suspension straps being adapted to be connected by connecting means to the hanger means of the hoist; and a pair of underarm support members, each adapted to extend beneath and support an armpit of the wearer, one of said underarm support members being secured at opposite ends thereof to each of said suspension straps of said first pair of suspension straps and the other of said underarm support members being secured at opposite ends thereof to each of said suspension straps of said second pair of suspension straps.

5. A torso sling as claimed in claim 4, said elongate support strap having length adjustment means to adjust the length of said elongate support strap to snugly engage the torso of the wearer when said opposing ends thereof are fastened together.

6. A torso sling as claimed in claim 4, wherein each one of said pair of said underarm support members further comprises an intermediate padded section.

7. A torso sling as claimed in claim 5, wherein said releasable fastening and length adjustment means comprises at least one elongate fastening strap having one end thereof secured to one of the opposite ends of said support strap and having its other end free and adapted to be inserted and drawn through a ring member secured to the other of said opposite ends of said support strap, whereby said free end of said fastening strap can be drawn through said ring member and back over said one end of said support strap until said support strap is snugly engaged around the torso of the wearer and said free end of said support strap is releasably attached to said support strap by strip fastening means at a point adjacent said one end of said support strap.

* * * * *